US006672126B2

(12) United States Patent
Hodjat

(10) Patent No.: US 6,672,126 B2
(45) Date of Patent: Jan. 6, 2004

(54) STEPPED CAM DIE

(75) Inventor: Yahya Hodjat, Oxford, MI (US)

(73) Assignee: The Gates Corporation, Denver, CO (US)

( * ) Notice: Subject to any disclaimer, the term of this patent is extended or adjusted under 35 U.S.C. 154(b) by 0 days.

(21) Appl. No.: 10/107,019

(22) Filed: Mar. 25, 2002

(65) Prior Publication Data

US 2003/0177808 A1 Sep. 25, 2003

(51) Int. Cl.[7] ..... B21D 22/26
(52) U.S. Cl. ..... 72/348; 72/354.2
(58) Field of Search ..... 72/81, 207, 208, 72/240, 354.2, 452.8, 452.9, 348

(56) References Cited

U.S. PATENT DOCUMENTS

| | | | | |
|---|---|---|---|---|
| 1,248,482 A | * | 12/1917 | Grob | 72/348 |
| 2,003,981 A | | 6/1935 | Stanitz et al. | 153/70 |
| 2,339,686 A | * | 1/1944 | Dewey et al. | 72/81 |
| 2,368,973 A | * | 2/1945 | Dewey | 72/81 |
| 3,233,444 A | * | 2/1966 | Groves et al. | 72/207 |
| 3,796,085 A | | 3/1974 | Fisher et al. | 72/348 |
| 4,471,680 A | | 9/1984 | Gerhart | 83/588 |
| 4,866,831 A | | 9/1989 | Lanzerath et al. | 29/159.2 |
| 4,876,876 A | | 10/1989 | Ishida et al. | 72/348 |
| 5,101,705 A | | 4/1992 | Matsuoka | 83/588 |
| 5,269,167 A | | 12/1993 | Gerhart | 72/381 |
| 5,465,602 A | | 11/1995 | Hashimoto et al. | 72/347 |
| 5,487,296 A | | 1/1996 | Gerhart et al. | 72/381 |
| 5,647,242 A | | 7/1997 | Saunders | 72/349 |
| 5,711,180 A | | 1/1998 | Sasahara et al. | 72/381 |
| 5,758,536 A | | 6/1998 | Jeong | 72/359 |
| 5,901,599 A | | 5/1999 | Sato et al. | 72/350 |
| 6,018,977 A | | 2/2000 | Kanno et al. | 72/355.4 |

FOREIGN PATENT DOCUMENTS

| | | | |
|---|---|---|---|
| EP | 1 008 404 A1 | 6/2000 | B21K/1/30 |
| WO | 02/22288 A2 | 3/2002 | B21D/53/28 |

* cited by examiner

*Primary Examiner*—Lowell A. Larson
(74) *Attorney, Agent, or Firm*—J. A. Thurnau, Esq.; C. H. Castleman, Esq.; S. G. Austin, Esq.

(57) ABSTRACT

The invention comprises a cam die. The cam die comprises at least one cam ring. The cam ring comprises a plurality of moveable cam teeth. The cam teeth are moveable on a normal toward an axis of the cam die by a cam actuator. The cam actuator has an inside diameter that is less than an outside diameter of the cam ring. As the cam actuator moves parallel to the cam die axis along an outside circumference of the cam ring, the cam teeth are progressively engaged and pressed inwardly toward a work piece. The work piece is moved simultaneously with the cam actuator by action of a punch that is concentric with the cam actuator and within the diameter of the cam ring. Each cam tooth is simultaneously engaged with the work piece as the work piece passes. A resilient member returns each cam tooth to a starting position after the cam actuator is withdrawn, allowing ejection of a finished part.

11 Claims, 6 Drawing Sheets

STEPPED CAM DIE

FIELD OF THE INVENTION

The invention relates to cam dies, and more particularly to stepped cam die having at least one cam ring actuated by a cam actuator.

BACKGROUND OF THE INVENTION

Sprockets are widely known and used as a means of transmitting power between shafts. Power transmission sprockets are made in several ways. Sheet metal types are fabricated by spinning or cam dies. In this method, the teeth or cogs are formed in a perpendicular motion of the die to the pre-form. Sprockets may also be formed by a punch and die system. A punch is used to axially press a work piece through a die.

Representative of the art is U.S. Pat. No. 3,796,085 to Fisher et al. which discloses a method for making sprockets by die drawing a disc into a cup shaped member while simultaneously forming the sprocket teeth thereon.

Also representative of the art is U.S. Pat. No. 5,269,167 to Gerhart which discloses an adjustable aerial cam unit for use in a power press. A slide block is slideably mounted at an angle relative to the plane of movement of the ram to move between extended and retracted positions.

The prior art methods suffer from creating a burr at the end of a part by relying solely on either on an in-and-out motion (horizontal) or on a vertical motion. Further, it is relatively complex requiring a plurality of moving parts as is found in multi-station fabrication, which necessarily adds cost to the finished part. Further, due to limitations in plastic flow, prior art methods of stamping complex forms in a single stroke limits the complexity of the shaped surface. The metal tears or wrinkles if it is formed beyond certain limits in a single stroke.

What is needed is a cam die that forms a sprocket by a lateral and vertical movement of a cam ring. What is needed is a cam die that comprises a plurality of coaxial cam rings. What is needed is a cam die to press form a toothed sprocket using multi-stage forming in a single pressing operation. The present invention meets these needs.

SUMMARY OF THE INVENTION

The primary aspect of the present invention is to provide a cam die that forms a sprocket by a lateral and vertical movement of a cam ring.

Another aspect of the invention is to provide a cam die that comprises a plurality of coaxial cam rings.

Another aspect of the invention is to provide a cam die to press form a toothed sprocket using multi-stage forming in a single pressing operation.

Other aspects of the invention will be pointed out or made apparent by the following description of the invention and the accompanying drawings.

The invention comprises a cam die. The cam die comprises at least one cam ring. The cam ring comprises a plurality of moveable cam teeth. The cam teeth are moveable on a normal toward an axis of the cam die by a cam actuator. The cam actuator has an inside diameter that is less than an outside diameter of the cam ring. As the cam actuator moves parallel to the cam die axis along an outside circumference of the cam ring, the cam teeth are progressively engaged and pressed inwardly toward a work piece. The work piece is moved simultaneously with the cam actuator by action of a punch that is concentric with the cam actuator and within the diameter of the cam ring. Each cam tooth is simultaneously engaged with the work piece as the work piece passes. A resilient member returns each cam tooth to a starting position after the cam actuator is withdrawn, allowing ejection of a finished part.

DESCRIPTION OF THE PREFERRED EMBODIMENT OF THE INVENTION

Figure 1:
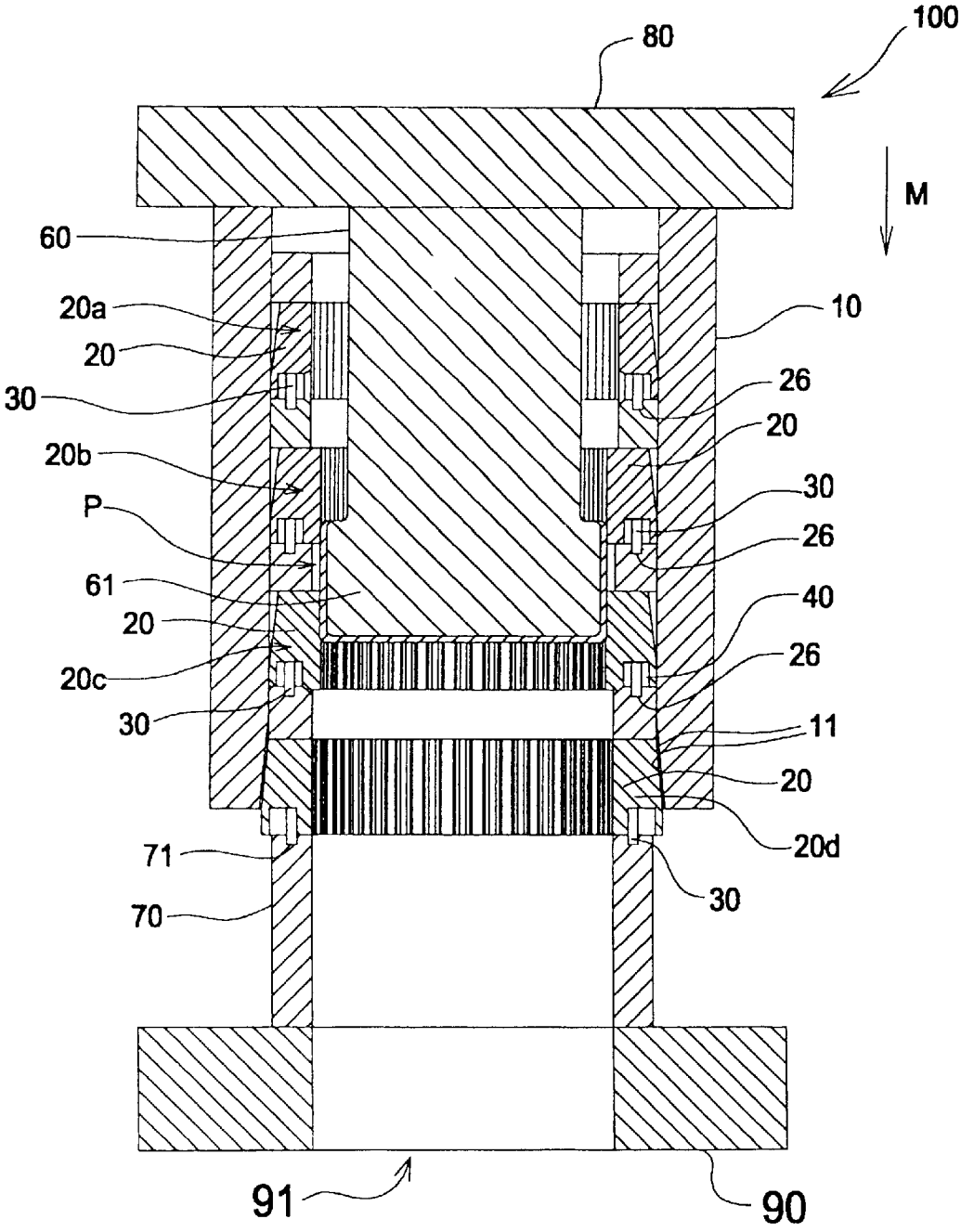
FIG. 1 is a cross-sectional view of the inventive tool.

FIG. 1 is a cross-sectional view of the inventive tool. The stepped cam die or tool generally comprises cam actuator 10, cam holder 70 and punch tool 60.

Cam actuator 10 comprises a substantially cylindrical shape having an axis. Extending coaxially within an inner bore of cam actuator 10 is punch tool 60. Cam actuator 10 and punch tool 60 are connected to base 80.

Cams 20 are moveably engaged with cam holder 70. Cams 20 are arranged in a cylindrical or ring shape. The present embodiment comprises four rings of cams, although any number of cam rings is possible. The cams in ring 20*a*, 20*b* and 20*c* are each shown in the pressed position, engaged with cam actuator 10. Cam ring 20*d* is not yet engaged with cam actuator 10 and is therefore in the un-pressed or free position.

Cam surface 25 slidingly engages cam actuator surface 11, thereby urging a cam radially inward toward a part P. Cam holder 70 comprises base 90. Base 90 describes bore 91.

Cam stops 30 extend about a radius of cam holder 70. Cam stops 30 are engaged with groove 26. Resilient member 40 is disposed between each cam 20 and cam stop 30. Resilient member 40 may comprise any elastomeric material having a compression modulus, including natural and synthetic rubbers and their equivalents. Resilient member 40 may also comprise a spring having a spring rate.

In operation, cam actuator 10 and punch tool 60 move in a direction M by operation of a hydraulic cylinder or other pressing mechanism known in the art. Part P is engaged with end 61 of punch tool 60 at a cycle beginning, wherein punch tool 60 is fully retracted from cam holder 70. Part P may comprise a cup shaped blank. Cam actuator 10 and punch tool 60 move in a direction M to press part P past each cam ring. A rim 13 on cam actuator 10 precedes part P in an axial direction in an amount sufficient to cause each cam 20 to fully engage a side of part P as it moves past each cam 20. As each cam ring is engaged by surface 11, the cams are pressed inward toward the part, thereby forming a shape in the part as dictated by surface 22. As each cam 20 is pressed inward, resilient member 40 is compressed against cam stop ring tooth 31. Once a part (not shown) is pushed past cam ring 20*d* by punch tool 60, the part drops through bore 91 into a receptacle (not shown). As cam actuator 10 is retracted, resilient member 40 expands thereby pushing each cam 20 outward.

The inside diameter of each ring has substantially the same outside diameter as a virgin part, that is, each of cam rings 20*a*, 20*b*, 20*c* and 20*d* in the un-pressed position have the same ID as a part P OD.

The end result is a stepped cam die, but the cams of each cam ring moves inward simultaneously as a part travels through the die. This results in an advantageous combination of horizontal and vertical forming.

One can appreciate that the inventive tool also allows simultaneous performance of several forming steps that otherwise in the prior art would require separate stages in a punch and die process. The separate prior art process requires the part to be handled more than once for each step of the forming process. Further no burrs are created in the finished part using the inventive tool requiring later removal.

Figure 2:
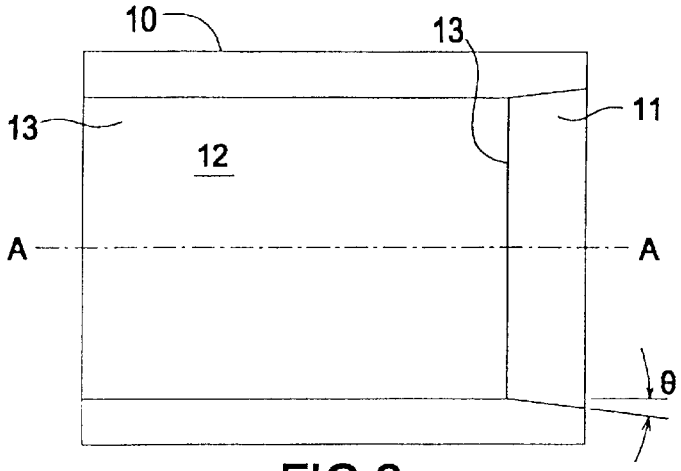
FIG. 2 is a cross-sectional view of a cam actuator.

FIG. 2 is a cross-sectional view of a cam actuator. Cam actuator 10 describes a substantially cylindrical form. Cam actuator surface 11 extends about an inner surface of cam actuator 10. Surface 11 describes an angle θ with respect to a centerline A—A. Cam actuator 10 also describes a bore 12 having an inner surface 13. Angle θ is substantially in the range of 15° to 60°.

Figure 3:
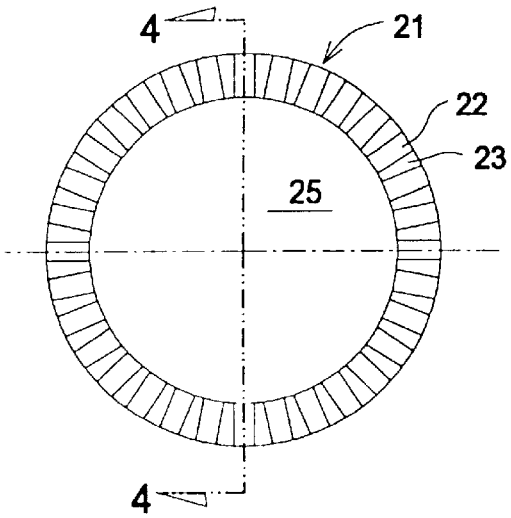
FIG. 3 is a plan view of a cam frame.

FIG. 3 is a plan view of a cam frame. Cam frame 21 generally describes a ring having a bore 25. Cam frame 21 comprises a plurality of teeth 23 describing a plurality of slots 22 which alternate with the teeth 23 on a base 24. A cam 20 is slidingly engaged in each slot 22. Each of teeth 23 describe a tapered shape in order to accommodate a substantially rectangular cam 20 in each slot 22. The number of slots 22 and thereby the number of cams 20 determines the number of teeth formed in each part during fabrication.

Figure 4:
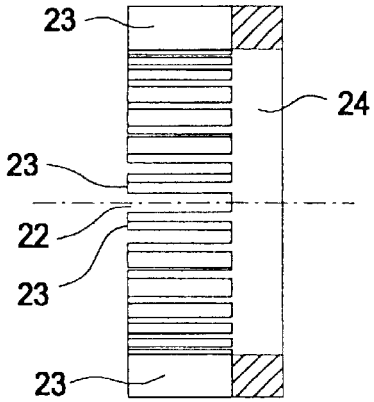
FIG. 4 is a side cross-sectional view of a cam frame at line 4—4 in FIG. 3.

FIG. 4 is a side cross-sectional view of a cam frame at line 4—4 in FIG. 3. Slots 22 are disposed symmetrically about a circumference of cam frame 21. Teeth 23 are arranged about a circumference of cam frame 21 on a ring-shaped base 24.

Figure 5:
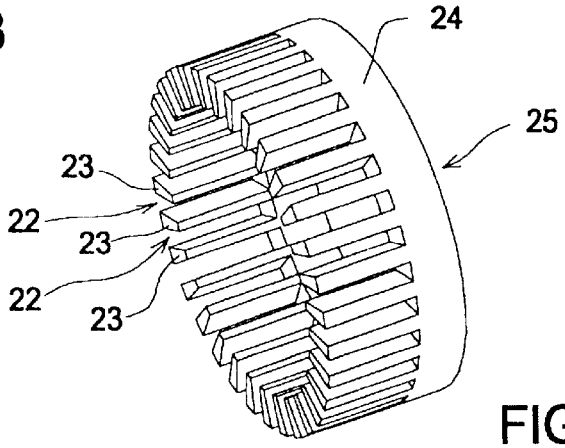
FIG. 5 is a perspective view of a cam frame.

FIG. 5 is a perspective view of a cam frame. The alternating pattern of teeth 23 and slots 22 about a bore 25 are clearly shown.

Figure 6:
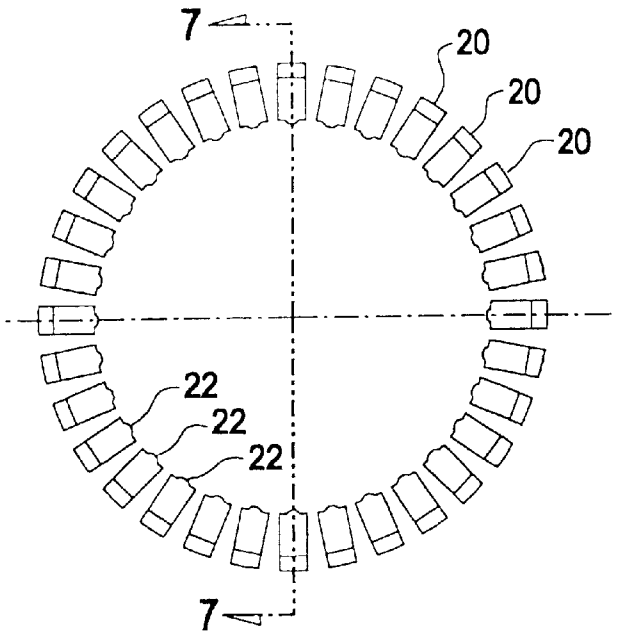
FIG. 6 is a plan view of the cams.

FIG. 6 is a plan view of the cams. Cams 20 are shown arranged in a substantially circular pattern about a circumference of cam frame 21. Forming surface 22 projects inwardly toward a part (not shown). Forming surface 22 may describe any form required to be formed into a part.

Figure 7:
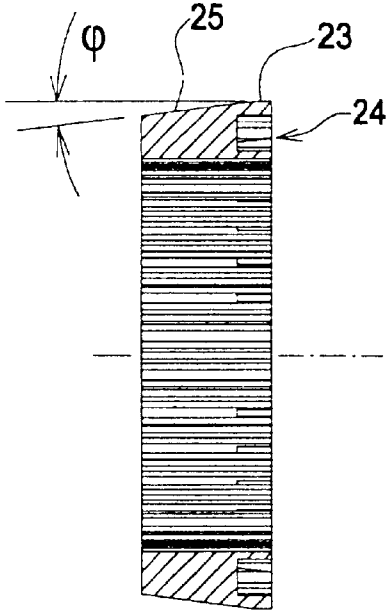
FIG. 7 is a side view of the cams at line 7—7 in FIG. 6.

FIG. 7 is a side view of the cams at line 7—7 in FIG. 6. Engaging surface 25 describes a sloped surface describing an angle ϕ. Angle ϕ substantially equals angle θ on actuator surface 11. On initial contact, surface 11 engages surface 25. So long as surface 11 is engaged with surface 25 cam 20 moves in a direction that is substantially radial, normal to an axis of the tool. Surface 23 engages actuator surface 13 as a cam 20 is fully engaged by the cam actuator 10. Each of cams 20 comprise slot 24 whereby a cam stop tooth 31 and resilient member 40 are engaged.

Figure 8:
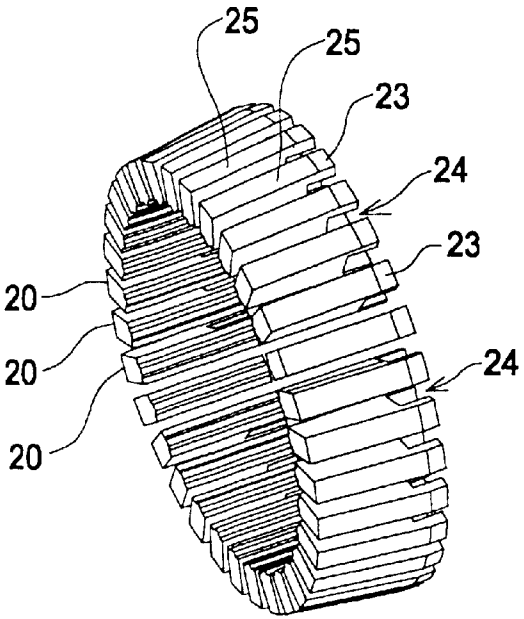
FIG. 8 is a perspective view of the cams.

FIG. 8 is a perspective view of the cams. The arrangement depicted in FIG. 8 is that which the cams describe when engaged in cam frame 21.

Figure 9C:
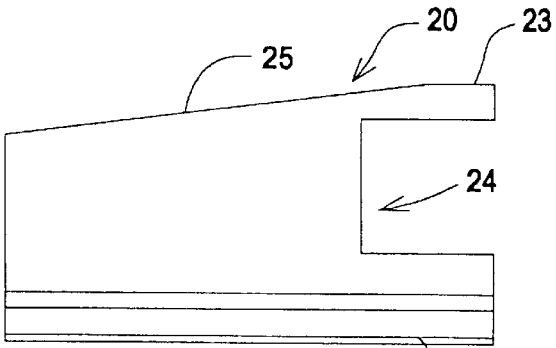
FIG. 9*c* is a side elevation view of a cam.
Figure 9A:
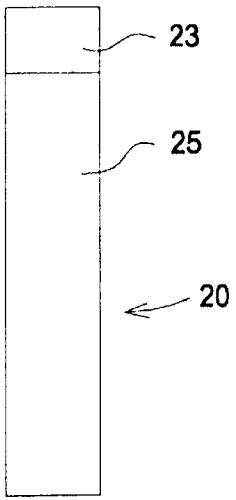
FIG. 9*a* is a back elevation view of a cam.

FIG. 9*a* is a back elevation view of a cam. Surface 23 engages cam actuator surface 13 when the cam is fully engaged. Surface 25 engages surface 11 on an initial contact with cam actuator 10 (not shown).

Figure 9B:
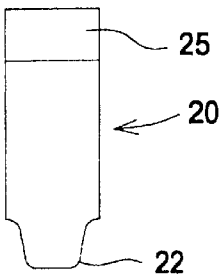
FIG. 9*b* is a top plan view of a cam.

FIG. 9*b* is a top plan view of a cam. Surface 25 engages surface 11 as the cam is being pressed into a part to be formed. Forming surface 22 engages a part to be formed.

FIG. 9*c* is a side elevation view of a cam. Slot 24 engages a cam stop ring tooth 31 and a resilient member 40.

Figure 10:
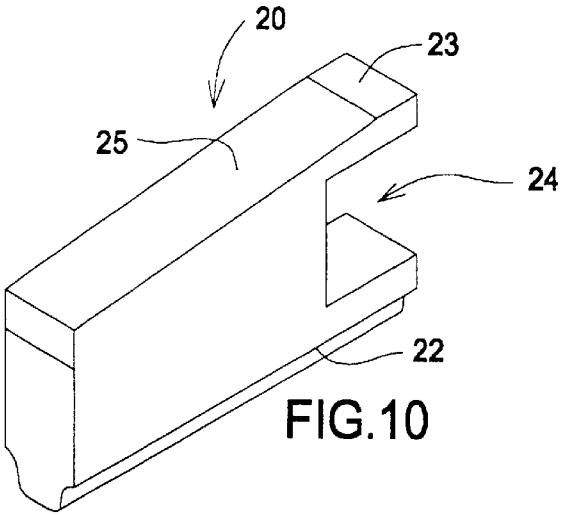
FIG. 10 is a perspective view of a cam.

FIG. 10 is a perspective view of a cam. Surface 22 may have any shape required to form a part.

Figure 11C:
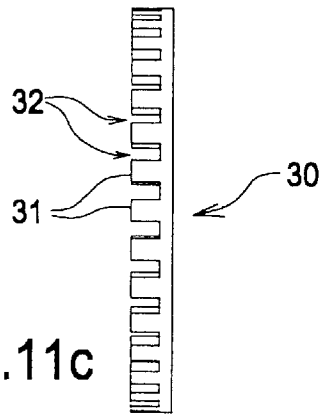
FIG. 11*c* is a side plan view of a cam stop ring.
Figure 11A:
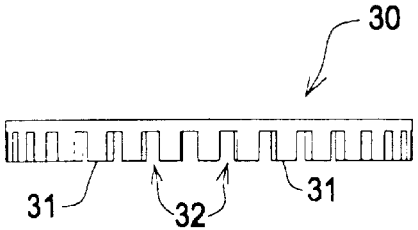
FIG. 11*a* is a side view of a cam stop ring.

FIG. 11*a* is a side view of a cam stop ring. Cam stop ring 30 comprises a ring shape describing a bore 34 and having teeth 31 with slots 32 disposed between teeth 31. Teeth 31 and slots 23 are disposed about a circumference of cam holder 21 on ring 33. Each of teeth 31 protrude into a slot 24 on cam 20, see FIG. 1 and FIG. 13.

Figure 11B:
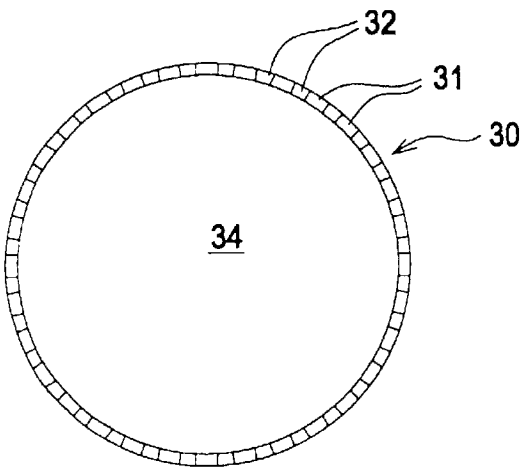
FIG. 11*b* is a top plan view of a cam stop ring.

FIG. 11*b* is a top plan view of a cam stop ring. Each of the teeth 31 and slots 32 are disposed about a bore 34 on cam stop ring base 33 to substantially match a position of each of the cams 20.

FIG. 11*c* is a side plan view of a cam stop ring.

Figure 12:
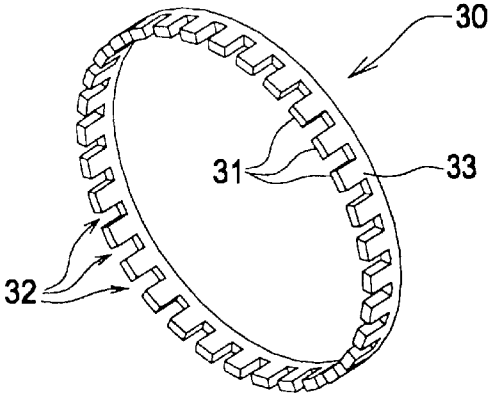
FIG. 12 is a perspective view of a cam stop ring.

FIG. 12 is a perspective view of a cam stop ring. Each cam stop ring 30 engages a cam frame 21 in a slot 26, or a cam holder 70 in a slot 71, see FIG. 13.

Figure 13:
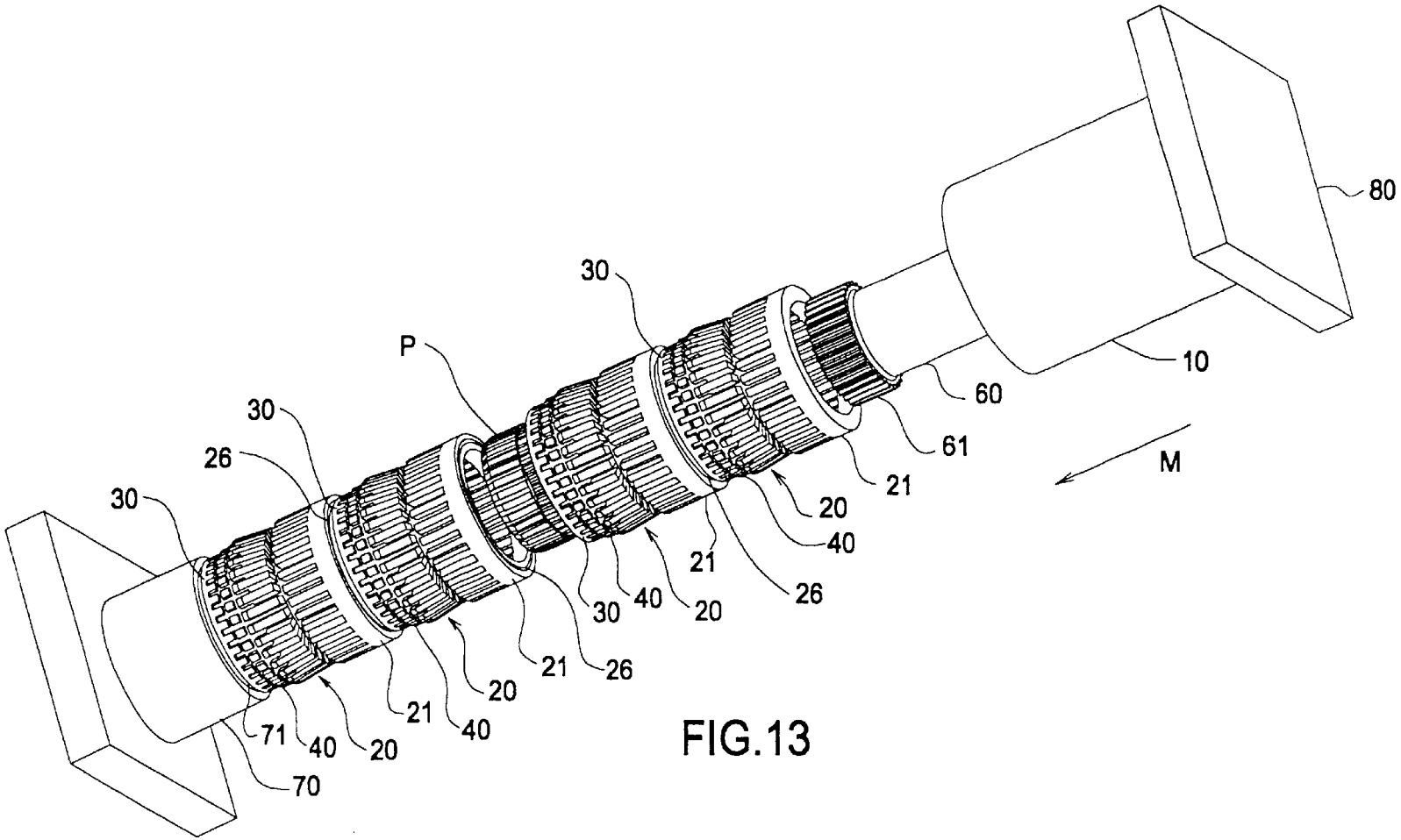
FIG. 13 is an exploded view of the inventive tool.

FIG. 13 is an exploded view of the inventive tool. One can appreciate from FIG. 13 that the components of the inventive tool can be readily assembled and disassembled as operations or maintenance may require. Each component is stacked on the other using precision machined surfaces and dowel pins as required. End 61 of punch tool 60 describes a surface having a form that cooperates with surface 22 on cam 20 in order to form a tooth sprocket part P.

Although a single form of the invention has been described herein, it will be obvious to those skilled in the art that variations may be made in the construction and relation of parts without departing from the spirit and scope of the invention described herein.

I claim:

1. A tool comprising:

a moveable member having a surface for slidingly engaging a cam;

the moveable member comprises a substantially cylindrical form describing a bore, the surface is disposed on an inner surface of the moveable member;

a cam slidingly engaged with an immovable member;

the cam urged in a pre-determined direction by an engagement with the moveable member; and a part member for bearing a part to be formed by the cam and disposed opposite the moveable member with respect to the cam, the part member moveable simultaneously with the moveable member.

2. The tool as in claim 1, wherein the part member is disposed in the bore.

3. The tool as in claim 2 further comprising:

a plurality of cams comprising a cam ring disposed in a substantially circular form about the immoveable member; and the cams are disposed on the immoveable member between the moveable member and the part member.

4. The tool as in claim 3 further comprising a resilient member for urging a cam in a predetermined direction.

5. The tool as in claim 4 further comprising a plurality of cam rings disposed adjacent on the immoveable member.

6. The tool as in claim 5 further comprising a plurality of stops, each stop limiting a movement of a cam.

7. The tool as in claim 5 wherein the immoveable member further comprises:

a bore for receiving the part member; and the plurality of cam rings are disposed about the bore.

8. A method of forming a part comprising the steps of:

slidingly engaging a substantially cylindrical moveable member bore surface with a cam;

slidingly engaging the cam with an immovable member;

urging the cam in a first pre-determined direction by an engagement with the moveable member; and simultaneously moving a part member for bearing a part to be formed by the cam and disposed opposite the moveable member with respect to the cam, with the moveable member.

9. The method as in claim 8 comprising the step of moving the part member in the cylindrical moveable member.

10. The method as in claim 9 comprising the step of moving a plurality of cams disposed in a substantially circular form.

11. The method as in claim 9 comprising the step of resiliently urging the cam in a predetermined direction opposite the first predetermined direction.

* * * * *